US011926498B2

(12) United States Patent
Hosohara et al.

(10) Patent No.: US 11,926,498 B2
(45) Date of Patent: Mar. 12, 2024

(54) SHEET FEEDING APPARATUS AND IMAGE FORMING APPARATUS

(71) Applicant: CANON KABUSHIKI KAISHA, Tokyo (JP)

(72) Inventors: Kazuhiro Hosohara, Kanagawa (JP); Tomoya Tateishi, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 127 days.

(21) Appl. No.: 17/747,220

(22) Filed: May 18, 2022

(65) Prior Publication Data

US 2022/0380153 A1 Dec. 1, 2022

(30) Foreign Application Priority Data

May 31, 2021 (JP) ..... 2021-091138

(51) Int. Cl.
*B65H 3/46* (2006.01)
*B65H 3/06* (2006.01)

(52) U.S. Cl.
CPC ..... *B65H 3/0684* (2013.01)

(58) Field of Classification Search
CPC ..... B65H 3/06; B65H 3/0684; B65H 3/46; B65H 3/56; B65H 3/565
See application file for complete search history.

(56) References Cited

U.S. PATENT DOCUMENTS

| | | | | |
|---|---|---|---|---|
| 8,118,299 | B2 * | 2/2012 | Sato | G03G 15/6514 271/118 |
| 9,938,097 | B2 * | 4/2018 | Murakami | B65H 7/00 |
| 10,160,611 | B2 * | 12/2018 | Tateishi | B65H 3/0669 |
| 10,214,373 | B2 * | 2/2019 | Sata | H04N 1/00602 |
| 10,662,010 | B2 * | 5/2020 | Murakami | B65H 3/0669 |
| 11,242,213 | B2 * | 2/2022 | Zaitsu | B65H 3/0684 |
| 11,445,078 | B2 * | 9/2022 | Arakawa | B65H 3/0669 |
| 11,613,439 | B2 * | 3/2023 | Yokota | B65H 3/0669 271/122 |
| 2019/0193432 | A1 | 6/2019 | Tsukuda et al. | |

FOREIGN PATENT DOCUMENTS

| | | | |
|---|---|---|---|
| JP | 2002332130 | A | 11/2002 |
| JP | 2003063677 | A | 3/2003 |
| JP | 2019112187 | A | 7/2019 |

* cited by examiner

*Primary Examiner* — Leslie A Nicholson, III
(74) *Attorney, Agent, or Firm* — ROSSI, KIMMS & McDOWELL LLP

(57) ABSTRACT

A sheet feeding apparatus includes a sheet supporting portion, a feeding portion, a conveying portion configured to convey the sheet fed by the feeding portion, a separation member, a returning portion, the returning portion pushing the sheet back toward the sheet supporting portion by moving from a retracting position to a protruding position, and a pressing portion including a contact portion configured to contact the sheet. The pressing portion is configured to press the sheet from above via the contact portion such that the sheet is pushed toward the returning portion in a state where the returning portion is positioned at the protruding position and below the sheet.

15 Claims, 5 Drawing Sheets

SHEET FEEDING APPARATUS AND IMAGE FORMING APPARATUS

BACKGROUND OF THE INVENTION

Field of the Invention

The present invention relates to a sheet feeding apparatus for feeding sheets, and an image forming apparatus equipped with the sheet feeding apparatus.

Description of the Related Art

Hitherto, there has been proposed a sheet feeding apparatus equipped with an automatic sheet feeder base, hereinafter referred to as ASF base, on which sheets are supported, a feed roller for feeding the sheets supported on the ASF base, a torque limiter that abuts against the feed roller and separates the sheets one by one, and a return lever (refer for example to Japanese Patent Application Laid-Open Publication No. 2002-332130). A pressure plate for pressing the sheet toward the feed roller is attached to the ASF base. The torque limiter is arranged in a manner capable of abutting against and separating from the feed roller, and the return lever is configured to push back the sheet toward the ASF base.

However, the ASF base taught in Japanese Patent Application Laid-Open Publication No. 2002-332130 is inclined downward, such that if the sheet on the ASF base moves beyond the return lever unintentionally, multi-feeding of sheets may occur.

SUMMARY OF THE INVENTION

According to one aspect of the present invention, a sheet feeding apparatus includes a sheet supporting portion configured to support a sheet, a feeding portion configured liftably and lowerably between a feed position where the feeding portion is abutted against the sheet supported on the sheet supporting portion and an upper position where the feeding portion is separated upward from the sheet supported on the sheet support portion, the feeding portion being configured to feed the sheet by rotating at the feed position, a conveying portion configured to convey the sheet fed by the feeding portion, a separation member configured movably between an abutted position where the separation member is abutted against the conveying portion and forming a separation nip configured to separate the sheet fed by the feeding portion one by one and a separated position where the separation member is separated from the conveying portion, a returning portion configured movably between a protruding position where the returning portion is protruded to a conveyance path through which the sheet is passed and a retracting position where the returning portion is retracted from the conveyance path, the returning portion being protruded to the conveyance path at the protruding position between the feeding portion and the separation nip in a sheet conveyance direction, the returning portion pushing the sheet back toward the sheet supporting portion by moving from the retracting position to the protruding position, and a pressing portion including a contact portion configured to contact the sheet. The pressing portion is configured to press the sheet from above via the contact portion such that the sheet is pushed toward the returning portion in a state where the returning portion is positioned at the protruding position and below the sheet.

Further features of the present invention will become apparent from the following description of exemplary embodiments with reference to the attached drawings.

DESCRIPTION OF THE EMBODIMENTS

Entire Configuration

Figure 1:
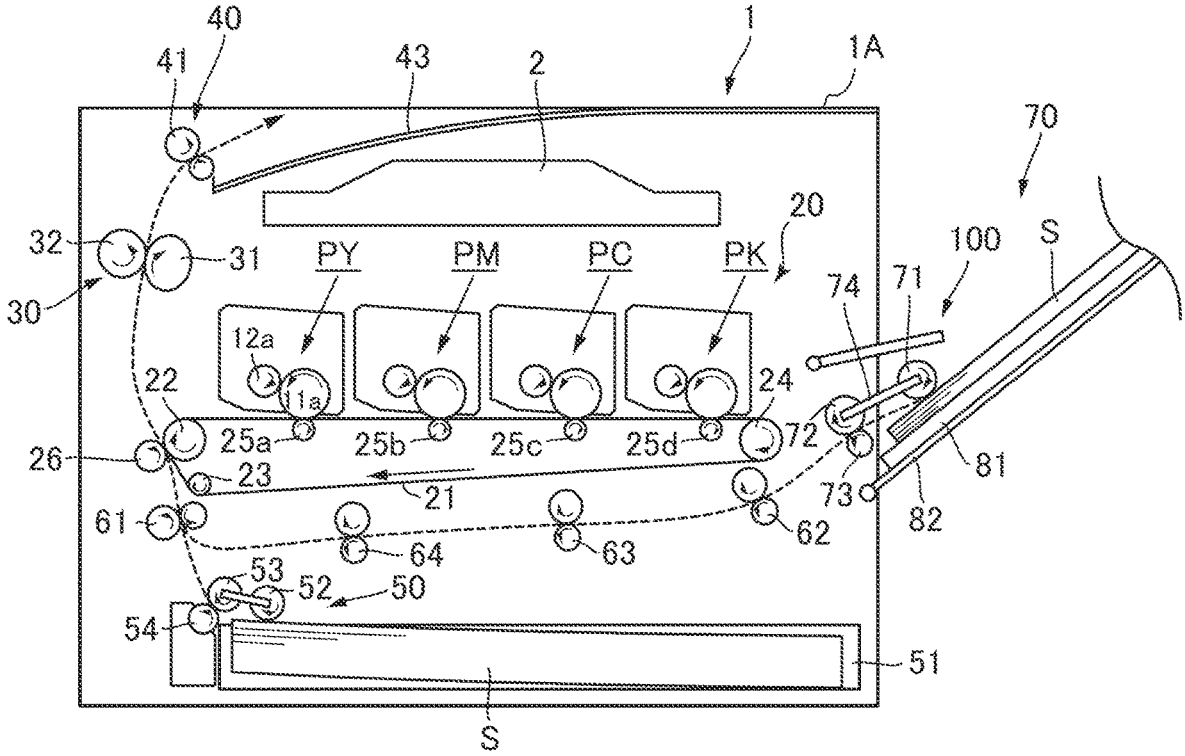
FIG. 1 is an entire schematic drawing illustrating a printer according to a present embodiment.

A printer 1 serving as an image forming apparatus is a laser beam printer adopting an electrophotographic system, and as illustrated in FIG. 1, the printer 1 includes an image forming unit 20 for forming an image on a sheet S, a cassette sheet feeding apparatus 50, a manual sheet feeding apparatus 70, and a fixing unit 30. The image forming unit 20 is equipped with four process cartridges PY, PM, PC, and PK respectively forming a color toner image of yellow (Y), magenta (M), cyan (C), and black (K), a scanner unit 2, and an intermediate transfer belt 21.

The four process cartridges PY, PM, PC, and PK adopt the same configuration except for the differences in the color of the images being formed. Therefore, only the configuration and image forming process of the process cartridge PY will be described, and the descriptions of the other process cartridges PM, PC, and PK will be omitted.

The process cartridge PY includes a photosensitive drum 11*a*, a charging roller not shown, and a developing roller 12*a*. The photosensitive drum 11*a* is configured by applying an organic photoconductive layer on an outer circumference of an aluminum cylinder and is rotated by a driving motor not shown. The intermediate transfer belt 21 is stretched across a drive roller 22, a driven roller 24, and a tension roller 23, and is rotated by the drive roller 22. Primary transfer rollers 25*a*, 25*b*, 25*c*, and 25*d* disposed on an inner side of the intermediate transfer belt 21. The fixing unit 30 includes a fixing film 31 heated by a heater, and a pressure roller 32 being in pressure contact with the fixing film 31.

The cassette sheet feeding apparatus 50 is disposed below the printer 1 and stores sheets S. The manual sheet feeding apparatus 70 serving as the sheet feeding apparatus includes a door 82 that is supported in an openable and closable manner an apparatus body 1A of the printer 1, a support tray 81 supported on the door 82, a sheet feed unit 100 for feeding the sheets S supported on the support tray 81, and a separation roller 73.

Next, an image forming operation of the printer 1 configured as above will be described. When an image signal is entered to the scanner unit 2 from a personal computer and the like not shown, a laser light corresponding to the image signal is irradiated from the scanner unit 2 to the photosensitive drum 11*a* of the process cartridge PY.

In this state, the surface of the photosensitive drum 11*a* is charged in advance to predetermined polarity and potential by a charging roller, and when laser light is irradiated from the scanner unit 2, an electrostatic latent image is formed on the surface thereof. The electrostatic latent image formed on the photosensitive drum 11*a* is developed by the developing roller 12*a*, and a yellow (Y) toner image is formed on the photosensitive drum 11*a*.

Similarly, the laser light from the scanner unit 2 is irradiated to each of the photosensitive drums of the process cartridges PM, PC, and PK, and toner images of magenta (M), cyan (C), and black (K) are formed on each of the photosensitive drums. The toner images of respective colors formed on the photosensitive drums are transferred by the primary transfer rollers 25*a*, 25*b*, 25*c*, and 25*d* to the intermediate transfer belt 21 and conveyed by the intermediate transfer belt 21 being rotated by the drive roller 22 to a secondary transfer roller 26. The image forming process of each toner color is performed at a corresponding timing at which the image is superposed to the toner image having been primarily transferred to the intermediate transfer belt 21 upstream thereof.

In parallel with the image forming process, the sheet S is fed from the cassette sheet feeding apparatus 50 or the manual sheet feeding apparatus 70. For example, in a case where the sheet S is fed from the cassette sheet feeding apparatus 50, the sheet S stored in the cassette 51 is sent out by a pickup roller 52 and thereafter separated sheet by sheet by a conveyance roller 53 and a separation roller 54. In a case where the sheet S is fed from the manual sheet feeding apparatus 70, the sheet S supported on the support tray 81 serving as the sheet supporting portion is fed by a pickup roller 71 and separated one by one by a conveyance roller 72 and the separation roller 73. Thereafter, the sheet S is conveyed by conveyance roller pairs 62, 63, and 64 toward a registration roller pair 61.

Skewing of the sheet S is corrected by the registration roller pair 61, and thereafter, the sheet S is conveyed in correspondence with the transfer timing. Then, a full-color toner image on the intermediate transfer belt 21 is transferred to the sheet S by a secondary transfer bias applied to the secondary transfer roller 26.

The sheet S to which the toner image has been transferred is subjected to predetermined heat and pressure by the fixing film 31 and the pressure roller 32 of the fixing unit 30, and toner is melted and hardened, i.e., fixed. The sheet S having passed through the fixing unit 30 is discharged onto a sheet discharge tray 43 by a sheet discharge roller pair 41 of a sheet discharge unit 40. The dashed arrow illustrated in FIG. 1 is an example of a conveyance path through which the sheet S is conveyed from the cassette sheet feeding apparatus 50 to the sheet discharge roller pair 41.

Manual Sheet Feeding Apparatus

Next, the manual sheet feeding apparatus 70 will be described with reference to FIGS. 2 to 3C. The manual sheet feeding apparatus 70 includes, as illustrated in FIGS. 2 to 3C, the sheet feed unit 100 supported attachably and detachably on the apparatus body 1A (refer to FIG. 1), and the separation roller 73.

Figure 2:
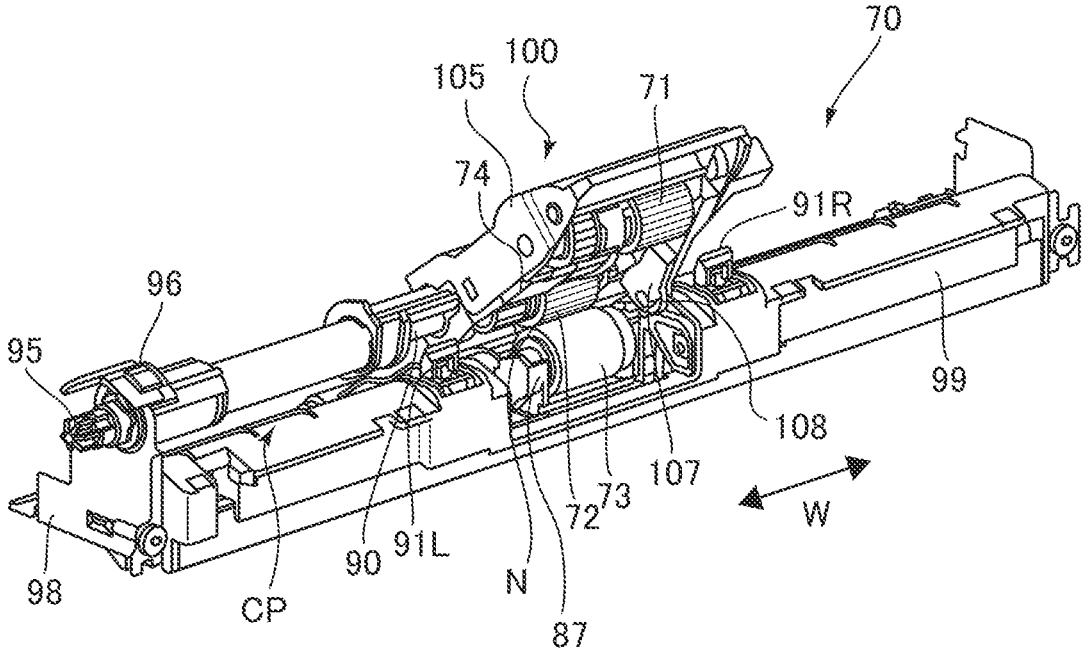
FIG. 2 is a perspective view illustrating a manual sheet feeding apparatus.

As illustrated in FIG. 2, a conveyance guide frame 98 is fixed to the apparatus body 1A (refer to FIG. 1), and a conveyance guide 99 is fixed to the conveyance guide frame 98. The conveyance guide 99 constitutes a part of a conveyance path CP through which the sheet S fed by the pickup roller 71 passes.

A separation holder 87 is supported pivotably about a separation shaft 87*a* (refer to FIG. 4A) on the conveyance guide 99, and the separation roller 73 is rotatably supported on the separation holder 87. The separation roller 73 serving as a separation member is provided swingably, i.e., movably, between an abutted position where the separation roller 73 is abutted against the conveyance roller 72 serving as the conveying portion and a separated position where the separation roller 73 is separated from the conveyance roller 72 by the separation holder 87 pivoting about the separation shaft 87*a*.

The separation roller 73 abuts against the conveyance roller 72 in the abutted position and forms a separation nip N where the sheets S fed by the pickup roller 71 serving as the feeding portion are separated one by one. The separation roller 73 includes a torque limiter not shown, and in a case where a plurality of sheets S exist at the separation nip N, exerts a function to separate the sheet to be conveyed by the conveyance roller 72 from other sheets. Meanwhile, if only one sheet S exists at the separation nip N, the torque limiter rotates idly and the separation roller 73 is driven to rotate following the rotation of the conveyance roller 72.

Further, returning claws 91L and 91R serving as returning portions are provided on the conveyance guide 99, and the returning claws 91L and 91R are arranged on one side and the other side of the separation roller 73 in a width direction W orthogonal to a sheet conveyance direction. The returning claws 91L and 91R are disposed movably between a protruding position (refer to FIG. 5A) where the returning claws 91L and 91R are protruded to the conveyance path CP in the area between the pickup roller 71 and the separation nip N in the sheet conveyance direction and a retracting position where the returning claws 91L and 91R are retracted from conveyance path CP. Further, the returning claws 91L and 91R push the sheet S positioned in the vicinity of the separation nip N back toward the support tray 81 by moving from the retracting position to the protruding position. A distance between the returning claws 91L and 91R in the width direction W is set smaller than a width of a smallest sized sheet that can be fed by the manual sheet feeding apparatus 70.

Figure 3A:
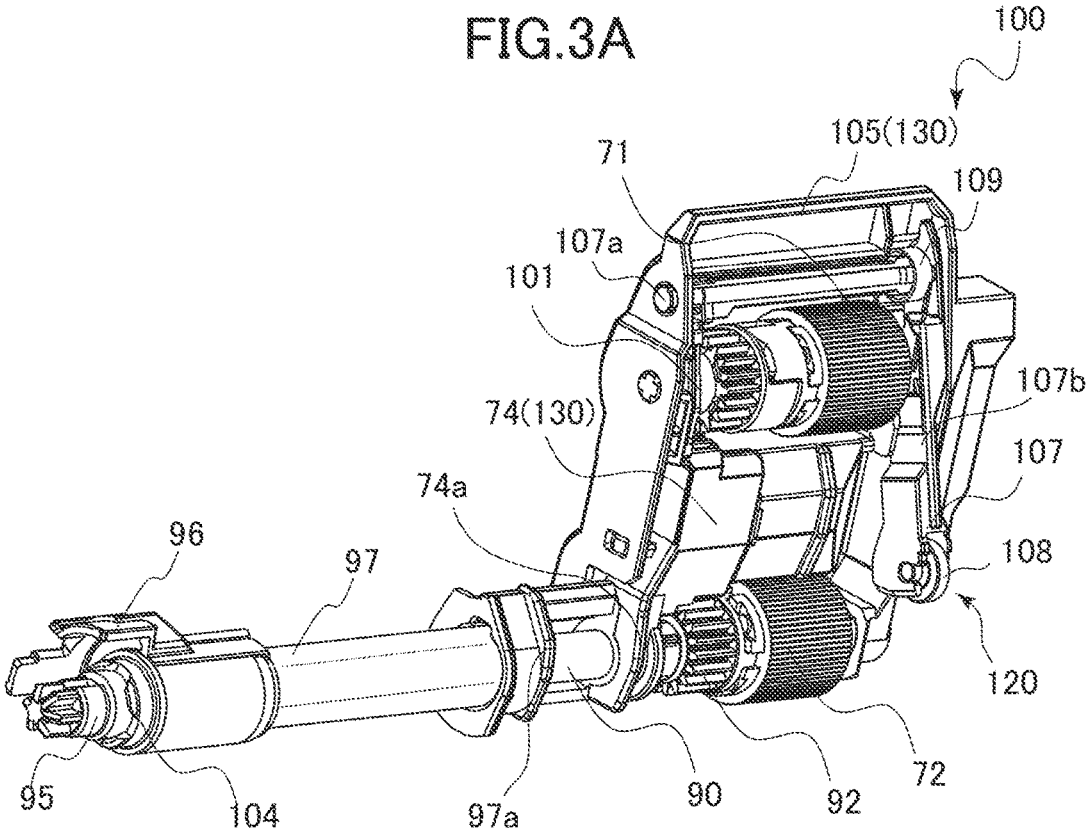
FIG. 3A is a perspective view illustrating a sheet feed unit.

The sheet feed unit 100 includes, as illustrated in FIG. 3A, a feed shaft 90, the conveyance roller 72 supported rotatably at a first end portion of the feed shaft 90, a feed gear 92 integrated with the conveyance roller 72, and a lifting arm shaft 97 having a cylindrical shape and in which is disposed the feed shaft 90. Further, the sheet feed unit 100 includes a lifting arm 74 supported pivotably on the feed shaft 90 and connected to the lifting arm shaft 97, and a roller cover 105 disposed to cover the lifting arm 74. Further, the sheet feed unit 100 includes the pickup roller 71 and a pickup gear 101 that are rotatably supported by the lifting arm 74 and the roller cover 105, and a pressing unit 120.

The feed shaft 90 includes a coupling portion 95 disposed on an end portion opposite from the conveyance roller 72, and when coupled to the apparatus body 1A, driving force can be entered thereto. In a state where the feed shaft 90 rotates, the conveyance roller 72 and the feed gear 92 rotate. The rotation of the feed gear 92 is transmitted via a drive train not shown supported on the lifting arm 74 to the pickup gear 101, by which a pickup roller 91 is rotated.

The lifting arm shaft 97 is relatively rotatable with respect to the feed shaft 90 and includes a coupling portion 96 coupled to a lifting and lowering mechanism provided on the apparatus body 1A (refer to FIG. 1). The lifting arm shaft 97 is rotated via the coupling portion 96, by which the lifting arm 74 and the roller cover 105 connected to the lifting arm shaft 97 is lowered. Thereby, the pickup roller 71 can be lifted and lowered between a feed position (refer to FIG. 5B) where the pickup roller 71 is abutted against the sheet supported on the support tray 81 and an upper position (refer to FIG. 5A) where the pickup roller 71 is separated upward from the sheet supported on the support tray 81. In other words, the lifting arm 74 and the roller cover 105 constitute a lifting holder 130 that supports the pickup roller 71 in a liftable and lowerable manner between the feed position and the upper position.

Further, the lifting arm 74 and the roller cover 105 can be configured to be urged upward by an urging member not shown or to be lifted and lowered by the lifting arm shaft 97 being driven.

Figure 3B:
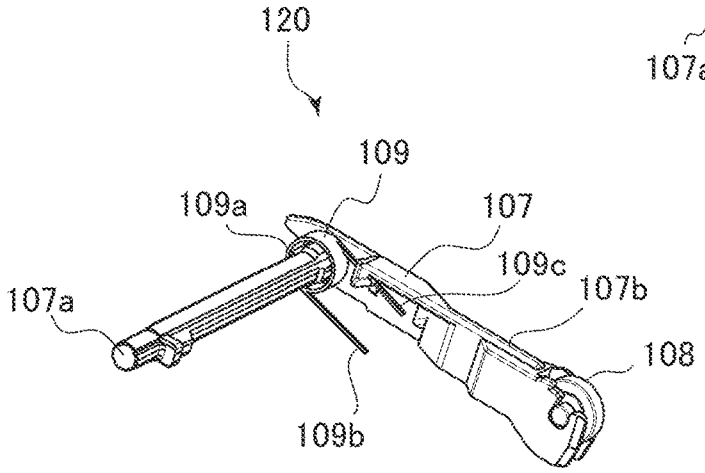
FIG. 3B is a perspective view illustrating a perspective view illustrating a pressing unit.
Figure 3C:
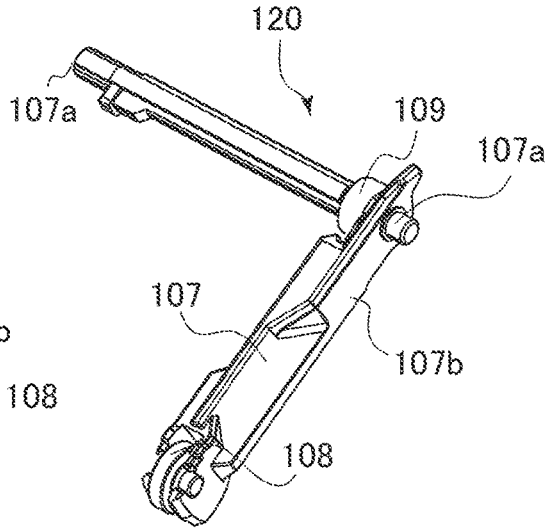
FIG. 3C is another perspective view illustrating the pressing unit.

The pressing unit 120 includes, as illustrated in FIGS. 3B and 3C, a pressing lever 107 serving as a pivoting portion, a pressing roller 108, and a torsion coil spring 109 serving as an urging portion. The pressing lever 107 is approximately L-shaped and includes a pivot shaft 107*a* supported pivotably on the roller cover 105, and a lever portion 107*b* extending in a direction orthogonal to the pivot shaft 107*a*. In other words, the lever portion 107*b* swings about the pivot shaft 107*a* with respect to the lifting holder 130 including the roller cover 105. The pressing roller 108 serving as a contact portion and a roller is rotatably supported on an end portion opposite from the pivot shaft 107*a* of the lever portion 107*b*. The pressing roller 108 is positioned between the conveyance roller 72 and the pickup roller 71 in a sheet conveyance direction CD described below. As described below, the pressing roller 108 is configured to press the sheet S toward the returning claws 91L and 91R. The pressing roller 108 is arranged at a position close to the conveyance roller 72 and the returning claws 91L and 91R than the pickup roller 71 in the sheet conveyance direction CD. Therefore, the pressing roller 108 can press the sheet S in the vicinity of the returning claws 91L and 91R. Further, the pivot shaft 107*a* is positioned upstream of the pickup roller 71 in the sheet conveyance direction CD. Thereby, the lever portion 107*b* can have a long length, and excessive pressing of the sheet S by the pressing roller 108 can be suppressed.

Further, a coil portion 109*a* of the torsion coil spring 109 is attached to the pivot shaft 107*a*, wherein a first end portion 109*b* of the torsion coil spring 109 is engaged with the roller cover 105, and a second end portion 109*c* of the torsion coil spring 109 is engaged with the lever portion 107*b*. Thereby, the pressing lever 107 is urged toward a direction in which the pressing roller 108 moves away from the roller cover 105, that is, urged downward.

Driving Mechanism

Figure 4A:
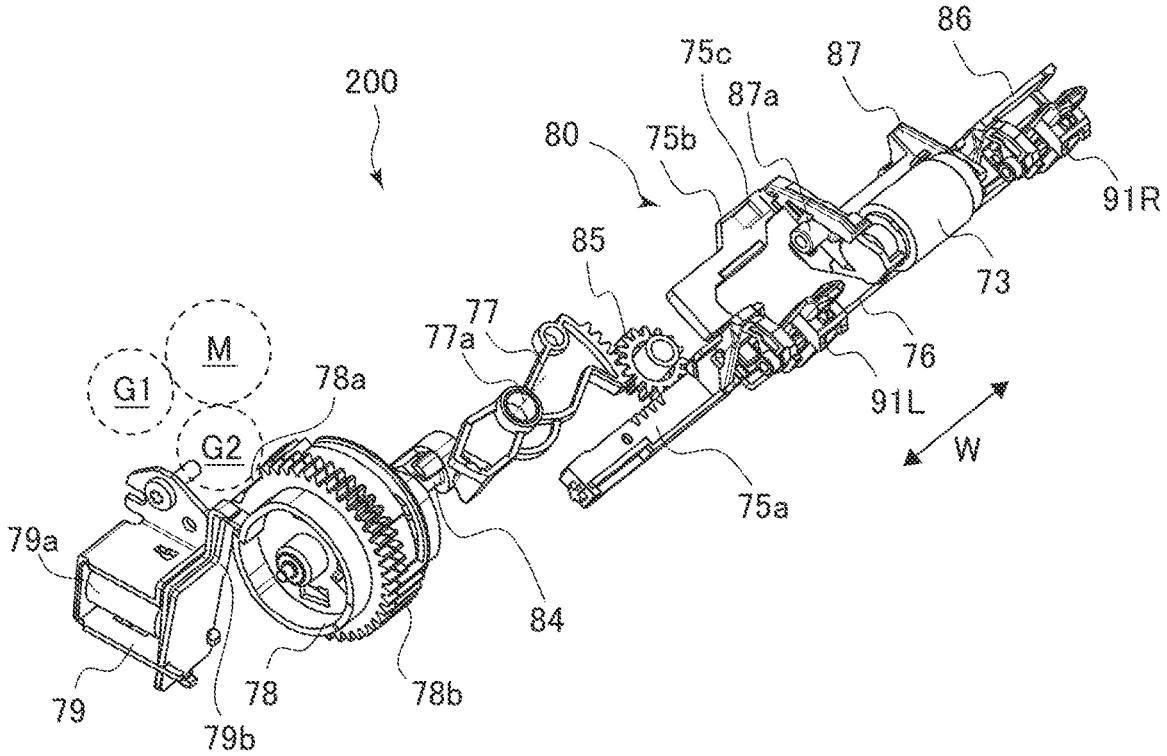
FIG. 4A is a perspective view illustrating a driving mechanism.
Figure 4B:
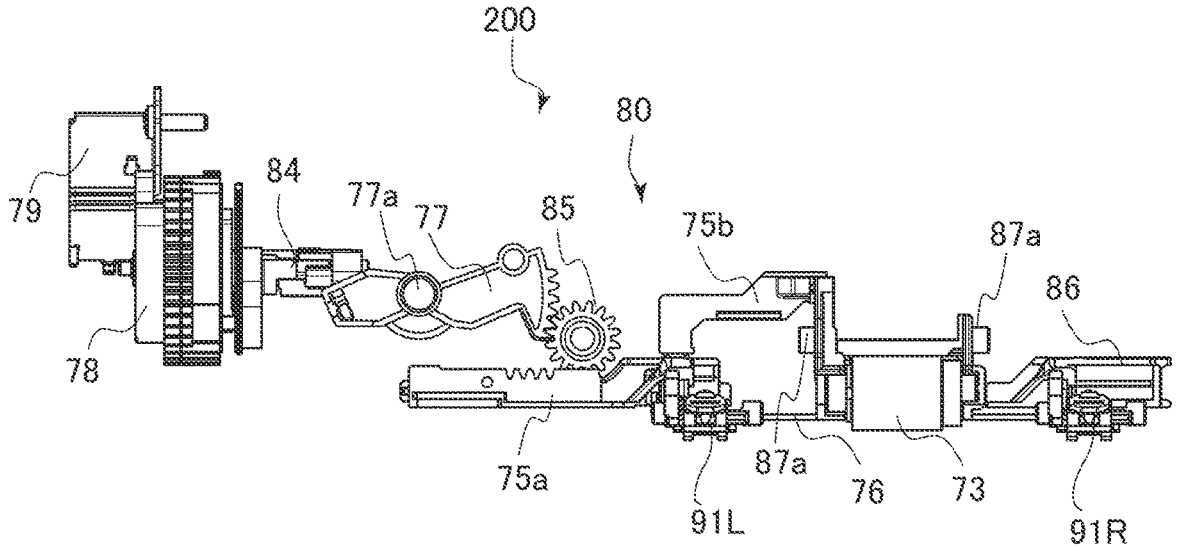
FIG. 4B is a plan view illustrating the driving mechanism.

Next, a driving mechanism 200 for driving the manual sheet feeding apparatus 70 will be described with reference to FIGS. 4A and 4B. The driving mechanism 200 includes, as illustrated in FIGS. 4A and 4B, a motor M serving as a driving source, a first transmission gear G1, a second transmission gear G2, a solenoid unit 79, a partially toothless gear 78 serving as a control gear, and an interlocking portion 80.

According to the present embodiment, the motor M can transmit driving force to both the cassette sheet feeding apparatus 50 and the manual sheet feeding apparatus 70. The motor M is meshed with the first transmission gear G1 and the second transmission gear G2, and the first transmission gear G1 can transmit driving force to the cassette sheet feeding apparatus 50. The second transmission gear G2 can transmit driving force to the manual sheet feeding apparatus 70. The second transmission gear G2 transmits drive to the coupling portion 95 (refer to FIG. 3A) of the feed shaft 90 via a drive train not shown. A clutch can be disposed between the motor M and the first transmission gear G1 or between the motor M and the second transmission gear G2. Further, the motor M, the first transmission gear G1, and the second transmission gear G2 are an example of a drive transmission configuration, and the present technique is not limited thereto.

The solenoid unit 79 includes a solenoid 79*a*, and an engaging claw portion 79*b* driven by the solenoid 79*a*. The engaging claw portion 79*b* is engaged with the partially toothless gear 78 in a state where the solenoid 79*a* is not energized. In this state, a toothless portion 78*a* where there are no teeth on the partially toothless gear 78 is opposed to the second transmission gear G2. In other words, in a state where the solenoid 79*a* is not energized, the rotation of the second transmission gear G2 is not transmitted to the partially toothless gear 78.

In a state where the solenoid 79*a* is energized, the engaging claw portion 79*b* is separated from the partially toothless gear 78, and the partially toothless gear 78 is somewhat rotated by a spring provided in the partially toothless gear 78, by which a gear portion 78*b* of the partially toothless gear 78 is meshed with the second transmission gear G2. The solenoid 79*a* will not be energized immediately after the engaging claw portion 79*b* separates from the partially toothless gear 78, such that when the partially toothless gear 78 rotates once, the partially toothless gear 78 will be locked again by the engaging claw portion 79*b*. As described, the partially toothless gear 78 is driven by the driving force from the motor M, controlled to rotate once, and stop per every rotation.

The interlocking portion 80 includes a control cam 84 coupled to the partially toothless gear 78, a reciprocation gear 77, an idler gear 85, a left side returning claw driving member 75*a*, a separation holder driving mechanism 75*b*, a coupling member 76, and a right side returning claw driving member 86. The reciprocation gear 77 is configured to move in reciprocating motion about a center of swing 77*a* like a pendulum by interlocking with the control cam 84. The reciprocation gear 77 is meshed with the idler gear 85, and the idler gear 85 is meshed with the left side returning claw driving member 75*a*. Thereby, the left side returning claw driving member 75*a* is moved in reciprocating motion in the width direction W.

The left side returning claw driving member 75*a* is coupled to the right side returning claw driving member 86 via the coupling member 76, and the right side returning claw driving member 86 is moved in reciprocating motion in the width direction W integrally with the left side returning claw driving member 75*a*. The left side returning claw driving member 75*a* and the right side returning claw driving member 86 each include a cam portion not shown that is engaged respectively with the returning claws 91L and 91R to move the returning claws 91L and 91R to the protruding position and the retracting position.

Further, the left side returning claw driving member 75*a* is also coupled to the separation holder driving mechanism 75*b*, and the separation holder driving mechanism 75*b* is moved in reciprocating motion in the width direction W integrally with the left side returning claw driving member 75*a*. The separation holder driving mechanism 75*b* is provided with a cam portion 75*c* that is engaged with the separation holder 87 and that pivots the separation holder 87 about the separation shaft 87*a*. In other words, by the reciprocating motion of the separation holder driving mechanism 75*b* in the width direction W, the separation roller 73 retained on the separation holder 87 swings to the abutted position and the separated position.

More specifically, the left side returning claw driving member 75*a* is urged to the width direction W by an urging member not shown. In the present embodiment, the left side returning claw driving member 75*a* is urged toward a direction approaching the separation roller 73 (right direction in FIG. 4B). Further, the separation holder 87 is urged by an urging member not shown toward a direction in which the separation roller 73 approaches the conveyance roller 72. The reciprocation gear 77 is rotated in a counterclockwise direction in FIG. 4B by the control cam 84 pressing the reciprocation gear 77, and the left side returning claw driving member 75*a* moves toward a left direction in FIG. 4B against the urging force urging the left side returning claw driving member 75*a*. In this state, the cam portion 75*c* and the separation holder 87 abut against each other, by which the separation roller 73 is positioned at the separated position against the urging force urging the separation holder 87. In this state, the returning claws 91L and 91R are positioned at the protruding position.

Meanwhile, in a state where the solenoid 79*a* is energized, the partially toothless gear 78 rotates and the control cam 84 moves away from the reciprocation gear 77. As a result, the left side returning claw driving member 75*a* moves toward a direction approaching the separation roller 73, i.e., right direction in FIG. 4B, by the urging force urging the left side returning claw driving member 75*a*. Then, the cam portion 75*c* and the separation holder 87 are separated, and the separation roller 73 is positioned at the abutted position by the urging force urging the separation holder 87. At this time, the returning claws 91L and 91R are positioned at the retracting position.

As described, in a state where the motor M is driven, driving force is entered via the second transmission gear G2, the partially toothless gear 78, and an idler gear not shown to the feed shaft 90, and the conveyance roller 72 and the pickup roller 71 are rotated thereby. Then, in a state where the solenoid 79*a* is energized, the partially toothless gear 78 rotates once, and the lifting arm shaft 97 and the lifting arm 74 are rotated via the coupling portion 96 by the movement of the lifting and lowering mechanism not shown that moves in linkage with the rotation of the partially toothless gear 78. Therefore, every time the partially toothless gear 78 rotates once, the pickup roller 71 is lifted and lowered to the upper position, the feed position, and the upper position in the named order. Each time the partially toothless gear 78 rotates once, the separation roller 73 is moved to the separated position, the abutted position, and the separated position in the named order, and the returning claws 91L and 91R are moved to the protruding position, the retracting position, and the protruding position in the named order.

In other words, the interlocking portion 80 includes the lifting and lowering mechanism not shown described above and the lifting arm shaft 97, and performs lifting and lowering of the pickup roller 71, the movement of the separation roller 73, and the movement of the returning claws 91L and 91R by interlocking with the partially toothless gear 78.

Feeding Operation Sequence and Operation of Pressing Roller

Figure 5A:
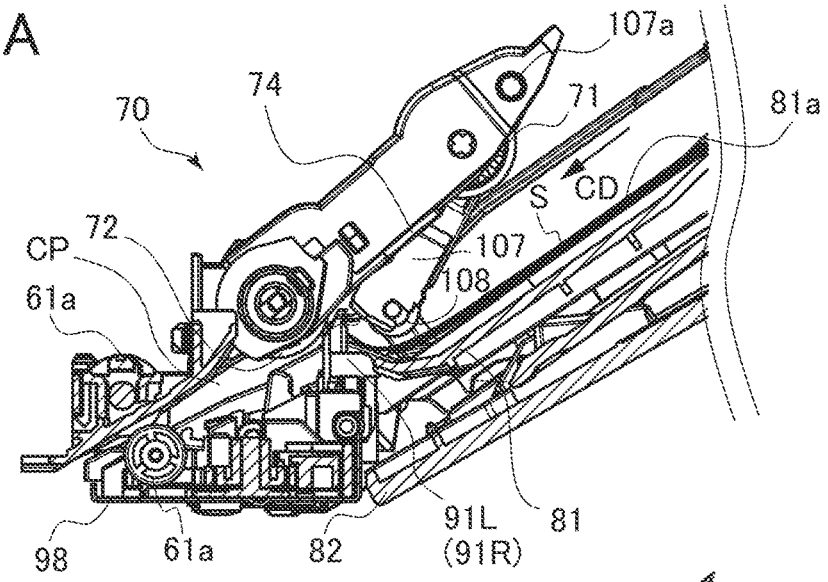
FIG. 5A is a side view illustrating a manual sheet feeding apparatus before starting sheet feed.
Figure 5B:
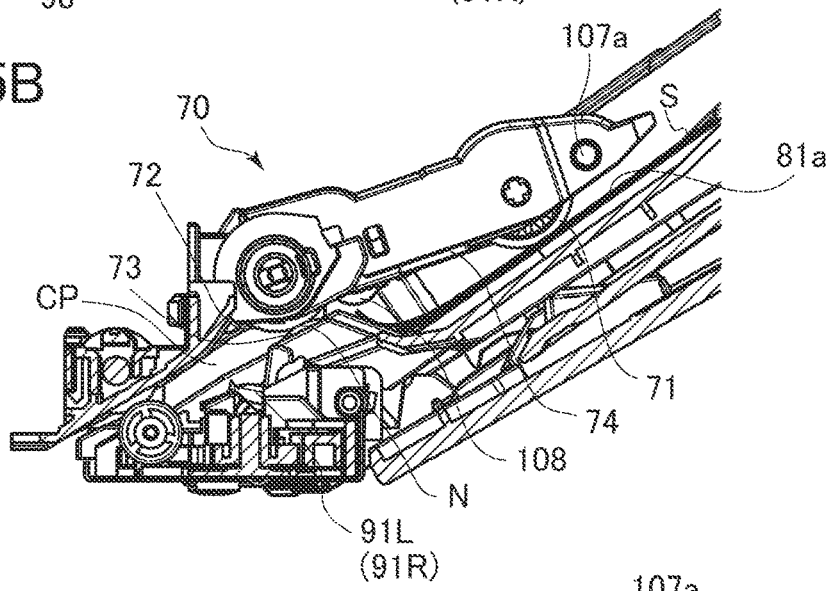
FIG. 5B is a side view illustrating the manual sheet feeding apparatus during sheet feed.
Figure 5C:
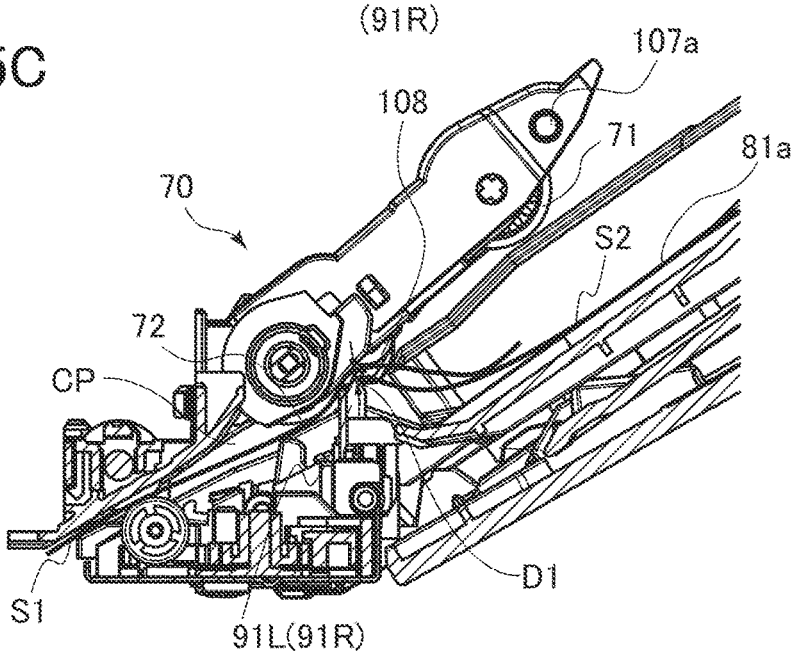
FIG. 5C is a side view illustrating the manual sheet feeding apparatus after a partially toothless gear has been rotated once.

Next, a feeding operation sequence and an operation of the pressing roller 108 by the manual sheet feeding apparatus 70 will be described with reference to FIGS. 5A to 5C. FIG. 5A is a side view illustrating the manual sheet feeding apparatus 70 before starting sheet feed. FIG. 5B is a side view illustrating the manual sheet feeding apparatus 70 during sheet feed. FIG. 5C is a side view illustrating the manual sheet feeding apparatus 70 after the partially toothless gear 78 has rotated once.

As illustrated in FIG. 5A, in a state where the door 82 is opened from the apparatus body 1A, the pickup roller 71 is positioned at the upper position, the separation roller 73 is positioned at the separated position, and the returning claws 91L and 91R are positioned at the protruding position. In this state, the pickup roller 71 is protruded to an outer side of the apparatus body 1A when viewed in a direction of a rotational axis, i.e., width direction W, of the pickup roller 71 (refer to FIG. 1). Then, by closing the door 82 with respect to the apparatus body 1A, the sheet feed unit 100 is stored in the apparatus body 1A.

Before a sheet feed instruction to the manual sheet feeding apparatus 70 is entered, the pickup roller 71 is positioned at the upper position and separated from a support surface 81*a* of the support tray 81. Therefore, the user can easily place the sheet S on the support surface 81*a*.

Before the sheet S is supported on the support surface 81*a*, the pressing roller 108 is also separated from the support surface 81*a*. That is, in a state where the sheet S is not supported on the support surface 81*a*, a gap is formed between the pressing roller 108 and the support surface 81*a*. Thereby, even in a case where the user slides a small amount of sheets on the support surface 81*a* from a user's side, occurrence of a sheet positioning failure in which the sheet stops before reaching a setting position of the sheet by resistance received from the pressing roller 108 can be reduced. Further, noise that may occur by the pressing roller 108 colliding against the support surface 81*a* after the last sheet on the support surface 81*a* has been fed can be prevented. According to the present embodiment, the movement of the pressing lever 107 beyond the predetermined position can be regulated by the roller cover 105 of the lifting holder 130 such that the pressing roller 108 does not abut against the support surface 81*a*.

In an open position in which the support tray 81 is opened from the apparatus body 1A, the support surface 81*a* is inclined downward toward a downstream side in the sheet conveyance direction CD. In other words, the support surface 81*a* is inclined such that a more downstream portion thereof in the sheet conveyance direction CD is lower. Therefore, the sheet S on the support surface 81*a* is designed to slide down by gravity toward the returning claws 91L and 91R positioned at the protruding position. Thereafter, the sheet S stands by in a state where a leading edge of the sheet S is positioned in a vicinity of the returning claws 91L and 91R.

Depending on the amount of sheets S set by the user on the support surface 81*a*, the sheet S abuts against the pressing roller 108. However, the pressing roller 108 is driven to rotate with respect to the sheets S set on the support surface 81*a*. That is, the pressing roller 108 is driven to rotate by friction received from the sheet S. Further, since the pivot shaft 107*a* of the pressing lever 107 is arranged upstream of the pressing roller 108 in the sheet conveyance direction CD, even if the pressing roller 108 contacts the sheet S, the pressing lever 107 and the pressing roller 108 can be retracted to the upper direction. Therefore, the user can set the sheet S easily on the support surface 81*a* without damaging the sheet S.

In a state where a feed instruction to the manual sheet feeding apparatus 70 is entered, a sheet presence sensor not shown determines where a sheet S exists on the support tray 81. If it is determined that the sheet S exists on the support tray 81, the motor M is driven, the solenoid 79*a* is simultaneously energized, and the partially toothless gear 78 starts to rotate. Thereby, as illustrated in FIG. 5B, the lifting arm 74 and the interlocking portion 80 are driven, and the pickup roller 71 is lowered to the feed position abutted against the sheet S. Further, the separation roller 73 moves to the abutted position, and the returning claws 91L and 91R move to the retracting position retracted from the conveyance path CP.

There is a case where the returning claws 91L and 91R move to the retracting position by its own weight by the cam portions of the left side returning claw driving member 75*a* and the right side returning claw driving member 86 moving away from the returning claws 91L and 91R, and a case where the returning claws 91L and 91R move to the retracting position by being pressed by the sheet S. Since the movement of the returning claws 91L and 91R in the retracting direction is not regulated, even in a case where the sheet S is abutted before being retracted, the returning claws 91L and 91R can be retrieved from the conveyance path CP without damaging the leading edge of the sheet S.

Since the pickup roller 71 and the conveyance roller 72 rotate by the rotation of the feed shaft 90, the sheet S is fed by the pickup roller 71 positioned at the feed position. Since the pickup roller 71 is only required to convey the leading edge of the sheet S to the separation nip N, the pickup roller 71 is configured to be lifted toward the upper position by the lifting arm 74 after a predetermined amount of sheets S has been conveyed.

After the leading end of the sheet S has been conveyed to the nip of the registration roller pair 61, the separation roller 73 is moved from the abutted position to the separated position. Further, after the separation nip N has been released, the returning claws 91L and 91R move from the retracting position to the protruding position and push back the sheet remaining in the vicinity of the separation nip N toward the support tray 81.

Now, as illustrated in FIG. 5C, the sheet conveyed by the registration roller pair 61 (refer to FIG. 1) serving as a downstream conveyance portion is referred to as a preceding sheet S1, and the sheet pushed back by the returning claws 91L and 91R is referred to as a succeeding sheet S2. The succeeding sheet S2 tends to move downstream in the sheet conveyance direction CD by frictional force received from the preceding sheet S1 being conveyed or the weight of the sheet itself. Especially, in a configuration in which the support surface 81*a* is inclined downward toward the downstream side in the sheet conveyance direction CD, the succeeding sheet S2 tends to move toward the downstream side in the sheet conveyance direction CD. If the succeeding sheet S2 moves toward the downstream side in the sheet conveyance direction CD beyond the returning claws 91L and 91R, multi-feed occurs since the separation nip N is released.

In order to reduce the occurrence of multi-feed of sheets, the pressing roller 108 supported on the pressing lever 107 presses the preceding sheet S1 from above such that the preceding sheet S1 is pushed toward the returning claws 91L and 91R in a state where the returning claws 91L and 91R are positioned below the preceding sheet S1. In other words, the pressing unit 120 (refer to FIG. 3B) serving as a pressing portion including the pressing lever 107 and the pressing roller 108 presses the preceding sheet S1 from above via the pressing roller 108 such that the preceding sheet S1 is pushed toward the returning claws 91L and 91R. In this state, the pressing roller 108 is positioned closer to the support surface 81*a* than the tip of the returning claws 91L and 91R in contact with the sheet. In other words, the pressing roller 108 is positioned closer to the base of the returning claws 91L and 91R than the tip of the returning claws 91L and 91R. The pressing lever 107 supporting the pressing roller 108 is urged downward about the pivot shaft 107*a* by its own weight and the torsion coil spring 109 (refer to FIG. 3B). As long as the preceding sheet S1 is pushed toward the returning claws 91L and 91R, the direction in which the pressing roller 108 presses the preceding sheet S1 may be deviated from the returning claws 91L and 91R. In the present embodiment, the direction of movement in which the pressing roller 108 is moved by the lever portion 107*b* can be deviated from the direction toward the returning claws 91L and 91R.

By pressing the preceding sheet S1 from above by the pressing roller 108, a gap D1 formed between the preceding sheet S1 and the returning claws 91L and 91R can be reduced, and the movement of the succeeding sheet S2 beyond the returning claws 91L and 91R can be suppressed. That is, since multi-feed occurs if the succeeding sheet S2 is conveyed in the sheet conveyance direction through the gap D1 formed between the preceding sheet S1 and the returning claws 91L and 91R, the gap D1 is narrowed by the pressing roller 108 so as to regulate the conveyance of the succeeding sheet S2. Further, as illustrated in FIGS. 2 and 3, conveyance ribs 74*a* and 97*a* are disposed on either side of the returning claw 91L in the width direction W. The conveyance rib 74*a* is disposed on the lifting arm 74 and the conveyance rib 97*a* is provided on the lifting arm shaft 97. The conveyance ribs 74*a* and 97*a* also have a function to reduce the gap D1 by pressing the preceding sheet S1 from above toward the returning claws 91L and 91R, similar to the pressing roller 108. In a state where the trailing edge of the preceding sheet S1 passes through the pressing roller 108, the state illustrated in FIG. 5A is resumed.

The manual sheet feeding apparatus 70 according to the present embodiment repeats the above-mentioned operation for each sheet to convey the sheets on the support tray 81. Further, the support tray 81 is disposed integrally with the door 82, and the support tray 81 is moved between an open position and a closed position by the door 82 being opened and closed with respect to the apparatus body 1A. The sheet feed unit 100 including the pressing unit 120 is moved in linkage with the opening and closing of the door 82, and the sheet feed unit 100 is stored in the apparatus body 1A by closing the door 82 when it is not used. Therefore, the size of the printer 1 will not be increased by adopting the pressing unit 120.

As described above, according to the present embodiment, the gap D1 between the sheet being conveyed and the returning claws 91L and 91R can be reduced by pressing the sheet S from above by the pressing roller 108 of the pressing unit 120. Thereby, multi-feed of sheets can be avoided by suppressing the succeeding sheet S from passing through the gap D1 and moving beyond the returning claws 91L and 91R.

Further, by configuring the pickup roller 71 in a liftable and lowerable manner, the pickup roller 71 can be protruded to the outer side of the apparatus body 1A together with the support tray 81 only during use, and the diameter of the pickup roller 71 can be reduced. Therefore, the whole apparatus can be downsized. Generally, if a configuration to lift and lower the support tray instead of the pickup roller is adopted, a large operating noise of the motor for lifting and lowering the support tray is generated, since the support tray supports sheets which are heavy. The present embodiment adopts a configuration in which the pickup roller 71 is lifted and lowered instead of lifting and lowering the support tray 81, such that the operating noise generated during conveyance of sheets can be reduced.

Further, since not only the pickup roller 71 but also the separation roller 73 is moved toward and away from the conveyance roller 72 per conveyance of each sheet, the wear of the pickup roller 71, the conveyance roller 72, and the separation roller 73 can be reduced, and longer service life can be realized. Moreover, since the pickup roller 71 is positioned at the upper position and the separation nip N is released when a sheet is conveyed by the registration roller pair 61, conveyance resistance can be reduced, and the driving motor can be downsized. Even further, since the lifting and lowering of the pickup roller 71 and the movement of the separation roller 73 and the returning claws 91L and 91R are controlled by the solenoid 79*a*, costs can be cut down.

OTHER EMBODIMENTS

In the present embodiment, a torque limiter system is adopted for the separation roller 73, but the present technique is not limited thereto. For example, the separation roller 73 can adopt a retard roller system in which a driving force for rotating the roller in a direction opposite the sheet conveyance direction is entered, or the roller can be replaced with a separation pad.

Further, returning claws 91L and 91R that are disposed on right and left sides have been adopted in the present embodiment, but the present technique is not limited thereto. The number of returning claws can be one, or even three or more.

Even further according to the present embodiment, the pressing roller 108 is disposed at the tip of the pressing lever 107 considering the conveyance of sheets having a surface vulnerable to damage, such as glossy paper, but the present technique is not limited thereto. For example, a configuration in which the pressing lever 107 is moved in sliding motion directly on the sheet can be adopted, depending on the type of sheet being conveyed. In other words, a contact portion capable of being in contact with the sheet can be disposed on a portion of the pressing lever 107.

According to the present embodiment, the pressing lever 107 is urged to pivot downward by the torsion coil spring 109, but the present technique is not limited thereto. For example, a configuration can be adopted in which an elastic member such as a compression spring that applies urging force is disposed instead of the torsion coil spring 109, or in which the torsion coil spring 109 is omitted and the pressing lever 107 is designed to pivot downward by its own weight.

Further according to the present embodiment, the pivot shaft 107*a* of the pressing lever 107 is arranged upstream of the pressing roller 108 in the sheet conveyance direction CD, but the present technique is not limited thereto. For example, the pivot shaft 107*a* can be arranged downstream of the pressing roller 108. Further, the pressing unit 120 including the pressing lever 107 can be supported on the apparatus body 1A instead of the lifting holder 130.

The present embodiment adopts a configuration in which the solenoid unit 79 causes the partially toothless gear 78 to stop per every rotation, but the present technique is not limited thereto. For example, the transmission and non-transmission of driving force from the motor M to the manual sheet feeding apparatus 70 can be realized by a clutch such as an electromagnetic clutch.

Further according to the present embodiment, the printer 1 adopting an electrophotographic system has been described as an example, but the present technique is not limited thereto. For example, the present technique is applicable to an image forming apparatus adopting an ink-jet system in which images are formed on sheets by discharging liquid ink through nozzles.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-091138, filed May 31, 2021, which is hereby incorporated by reference herein in its entirety.

What is claimed is:

1. A sheet feeding apparatus comprising:

a sheet supporting portion configured to support a sheet;

a feeding portion configured liftably and lowerably between a feed position where the feeding portion is abutted against the sheet supported on the sheet supporting portion and an upper position where the feeding portion is separated upward from the sheet supported on the sheet support portion, the feeding portion being configured to feed the sheet by rotating at the feed position;

a conveying portion configured to convey the sheet fed by the feeding portion;

a separation member configured movably between an abutted position where the separation member is abutted against the conveying portion and forming a separation nip configured to separate the sheet fed by the feeding portion one by one and a separated position where the separation member is separated from the conveying portion;

a returning portion configured movably between a protruding position where the returning portion is protruded to a conveyance path through which the sheet is passed and a retracting position where the returning portion is retracted from the conveyance path, the returning portion being protruded to the conveyance path at the protruding position between the feeding portion and the separation nip in a sheet conveyance direction, the returning portion pushing the sheet back toward the sheet supporting portion by moving from the retracting position to the protruding position; and a pressing portion including a contact portion configured to contact the sheet, the pressing portion being configured to press the sheet from above via the contact portion such that the sheet is pushed toward the returning portion in a state where the returning portion is positioned at the protruding position and below the sheet.

2. The sheet feeding apparatus according to claim 1, wherein, in a state where the returning portion is positioned at the protruding position, the feeding portion is positioned at the upper position and the separation member is positioned at the separated position.

3. The sheet feeding apparatus according to claim 1, further comprising a lifting holder configured to support the feeding portion, wherein the pressing portion includes a pivoting portion configured to be supported pivotably about a pivot shaft with respect to the lifting holder, and the contact portion being provided on the pivoting portion.

4. The sheet feeding apparatus according to claim 3, wherein the pivot shaft is arranged upstream of the contact portion in the sheet conveyance direction.

5. The sheet feeding apparatus according to claim 3, wherein the contact portion is a roller supported rotatably on the pivoting portion.

6. The sheet feeding apparatus according to claim 3, wherein the pressing portion includes an urging portion configured to urge the pivoting portion to pivot downward about the pivot shaft.

7. The sheet feeding apparatus according to claim 1, wherein the contact portion is arranged between the feeding portion and the conveying portion in the sheet conveyance direction.

8. The sheet feeding apparatus according to claim 1, wherein the contact portion is arranged at a position closer to the conveying portion than the feeding portion in the sheet conveyance direction.

9. The sheet feeding apparatus according to claim 1, wherein a gap is formed between the contact portion and the sheet supporting portion in a state where a sheet is not supported on the sheet supporting portion.

10. The sheet feeding apparatus according to claim 1, wherein the sheet supporting portion includes a support surface on which the sheet is supported, and is provided in an openable and closable manner with respect to an apparatus body between a closed position and an open position, and wherein the support surface is inclined downward toward a downstream side in the sheet conveyance direction in a state where the sheet supporting portion is positioned at the open position.

11. The sheet feeding apparatus according to claim 10, wherein the feeding portion is protruded to an outer side of the apparatus body in the feed position when viewed in a direction of a rotational axis of the feeding portion.

12. The sheet feeding apparatus according to claim 10, wherein the support surface is configured not to move in a state where the sheet supporting portion is positioned at the open position.

13. The sheet feeding apparatus according to claim 1, further comprising:

a control gear configured to be driven by a driving force from a driving source and stopped per every rotation; and an interlocking portion configured to lift and lower the feeding portion between the feed position and the upper position, move the separation member between the abutted position and the separated position, and move the returning portion between the retracting position and the protruding position by interlocking with the control gear.

14. The sheet feeding apparatus according to claim 1, further comprising a downstream conveyance portion arranged downstream of the separation nip in the sheet conveyance direction and configured to convey the sheet, wherein the pressing portion presses the sheet from above via the contact portion in a case where the returning portion is positioned at the protruding position and positioned under the sheet conveyed by the downstream conveyance portion.

15. An image forming apparatus comprising:

the sheet feeding apparatus according to claim 1; and an image forming unit configured to form an image on a sheet fed by the sheet feeding apparatus.

* * * * *